US005591276A

United States Patent [19]

Yoshizawa et al.

[11] Patent Number: 5,591,276

[45] **Date of Patent: *Jan. 7, 1997**

[54] MAGNETIC ALLOY WITH ULTRAFINE CRYSTAL GRAINS AND METHOD OF PRODUCING SAME

[75] Inventors: Yoshihito Yoshizawa, Fukaya; Yoshio Bizen; Shigekazu Suwabe, both of Kumagaya; Kiyotaka Yamauchi, Kumagaya; Toshikazu Nishiyama, Fukaya, all of Japan

[73] Assignee: Hitachi Metals, Ltd., Tokyo, Japan

[ * ] Notice: The term of this patent shall not extend beyond the expiration date of Pat. No. 4,918,555.

[21] Appl. No.: 154,715

[22] Filed: Nov. 19, 1993

Related U.S. Application Data

[63] Continuation of Ser. No. 896,878, Jun. 10, 1992, abandoned, which is a continuation of Ser. No. 616,979, Nov. 21, 1990, abandoned.

[30] Foreign Application Priority Data

Nov. 22, 1989 [JP] Japan ..... 1-303617

[51] Int. Cl.[6] ..... C22C 38/16

[52] U.S. Cl. ..... 148/304; 148/305; 148/306; 148/403; 420/83; 420/121

[58] Field of Search ..... 148/108, 304–311, 148/403; 420/83, 121

[56] References Cited

U.S. PATENT DOCUMENTS

| | | | |
|---|---|---|---|
| 4,312,683 | 1/1982 | Sakakima et al. | 148/304 |
| 4,379,004 | 4/1983 | Makino et al. | 148/108 |
| 4,439,236 | 3/1984 | Ray | 148/403 |
| 4,668,310 | 5/1987 | Kudo et al. | 420/83 |
| 4,918,555 | 4/1990 | Yoshizawa et al. | 148/307 |
| 5,084,795 | 1/1992 | Sakakima et al. | 148/306 |
| 5,225,006 | 7/1993 | Sawa et al. | 148/304 |

FOREIGN PATENT DOCUMENTS 61-30008 2/1986 Japan .

OTHER PUBLICATIONS

Journal of Applied Physics, vol. 62, No. 5, 1 Sep. 1987, New York US pp. 1948–1951; Y. Hara et al.: 'Fine-particle magnetism in the devitrified metallic glass Fe43Cr25Ni20B12'.

Patent Abstracts of Japan, vol. 8, No. 285 (E–287)(1722) 26 Dec. 1984 & JP–59 150 404 (Toshiba K.K.) 28 Aug. 1984.

Patent Abstracts of Japan, vol. 7, No. 52 (E–162)(1197) 2 Mar. 1983 & JP–57 202 709 (Hitachi Kinzoku K.K.) 11 Dec. 1982.

Patent Abstracts of Japan, vol. 13, No. 221 (C–598)(3569) 23 May 1989 & JP–1 031 922 (Hitachi Metals Ltd) 2 Feb. 1989.

Patent Abstracts of Japan, vol. 7, No. 36 (E–158)(1181) 15 Feb. 1983 & JP–57 190 304 (Hitachi Kinzoku K.K.) 22 Nov. 1982.

*Primary Examiner*—Sikyin Ip

*Attorney, Agent, or Firm*—Sughrue, Mion, Zinn, Macpeak & Seas

[57] ABSTRACT

There is provided according to the present invention a magnetic alloy with ultrafine crystal grains having a composition represented by the general formula:

$$Fe_{100-x-y}M_xB_y \text{ (atomic \%)}$$

wherein M represents at least one element selected from Ti, Zr, Hf, V, Nb, Mo, Ta, Cr, W and Mn, $4 \leqq x \leqq 15$, $2 \leqq y \leqq 25$, and $7 \leqq x+y \leqq 35$, at least 50% of the alloy structure being occupied by crystal grains having an average grain size of 500 Å or less, and the crystal grains being based on a bcc structure. It may further contain X (Si, Ge, P, Ga, etc.) and/or T (Au, Co, Ni, etc.). This magnetic alloy has an excellent saturation magnetic flux density, permeability and heat resistance.

25 Claims, 4 Drawing Sheets

MAGNETIC ALLOY WITH ULTRAFINE CRYSTAL GRAINS AND METHOD OF PRODUCING SAME

This is a Continuation of application Ser. No. 07/896,878, filed Jun. 10, 1992, abandoned, which is a continuation of application Ser. No. 07/616,979 filed Nov. 21, 1990, abandoned.

BACKGROUND OF THE INVENTION

The present invention relates to a magnetic alloy with ultrafine crystal grains excellent in magnetic properties and their stability, a major part of the alloy structure being occupied by ultrafine crystal grains, suitable for magnetic heads, etc.

Conventionally used as magnetic materials for magnetic parts such as magnetic heads are ferrites, showing relatively good frequency characteristics with small eddy current losses. However, ferrites do not have high saturation magnetic flux densities, so that they are insufficient for high-density magnetic recording of recent magnetic recording media when used for magnetic heads. In order that magnetic recording media having high coercive force for high-density magnetic recording show their performance sufficiently, magnetic materials having higher saturation magnetic flux densities and permeabilities are needed. To meet such demands, thin Fe-Al-Si alloy layers, thin Co-Nb-Zr amorphous alloy layers, etc. are recently investigated. Such attempts are reported by Shibata et al., NHK Technical Report 29 (2), 51–106 (1977), and by Hirota et al., Kino Zairyo (Functional Materials) August, 1986, p. 68, etc.

However, with respect to the Fe-Al-Si alloys, both magnetostriction $\lambda_s$ and magnetic anisotropy K should be nearly zero to achieve high permeability. These alloys, however, achieve saturation magnetic flux densities of only 12 kG or so. Because of this problem, investigation is conducted to provide Fe-Si alloys having higher saturation magnetic flux densities and smaller magnetostrictions, but they are still insufficient in corrosion resistance and magnetic properties. In the case of the above Co-base amorphous alloys, they are easily crystallized when they have compositions suitable for higher saturation magnetic flux densities, meaning that they are poor in heat resistance, making their glass bonding difficult.

Recently, Fe-M-C (M=Ti, Zr, Hf) layers showing high saturation magnetic flux densities and permeabilities were reported in Tsushin Gakkai Giho (Telecommunications Association Technical Report) MR89-12, p. 9. However, carbon atoms contained in the alloy are easily movable, causing magnetic aftereffect, which in turn deteriorates the reliability of products made of such alloys.

OBJECT AND SUMMARY OF THE INVENTION

Accordingly, an object of the present invention is to provide a magnetic alloy having excellent magnetic properties, heat resistance and reliability.

As a result of intense research in view of the above object, the inventors have found that a magnetic alloy based on Fe, M and B (M represents at least one element selected from Ti, Zr, Hf, V, Nb, Mo, Ta, Cr, W and Mn), at least 50% of the alloy structure being occupied by crystal grains having an average grain size of 500 Å or less, and the crystal grains being based on a bcc structure, has high saturation magnetic flux density and permeability and also good heat resistance, suitable for magnetic cores. The present invention has been made based upon this finding.

Thus, the magnetic alloy with ultrafine crystal grains according to the present invention has a composition represented by the general formula:

$$Fe_{100-x-y}M_xB_y \text{ (atomic \%)}$$

wherein M represents at least one element selected from Ti, Zr, Hf, V, Nb, Mo, Ta, Cr, W and Mn, $4 \leqq x \leqq 15$, $2 \leqq y \leqq 25$, and $7 \leqq x+y \leqq 35$, at least 50% of the alloy structure being occupied by crystal grains having an average grain size of 500 Å or less, and the crystal grains being based on a bcc structure.

BRIEF DESCRIPTION OF THE DRAWINGS

FIG. 1 (*b*) is a graph showing an X-ray diffraction pattern of the alloy of the present invention heat-treated at 600° C.;

FIG. 2 (*b*) is a graph showing the relation between an effective permeability ($\mu_{e1k}$) and a heat treatment temperature;

DETAILED DESCRIPTION OF THE INVENTION

Figure 1A:
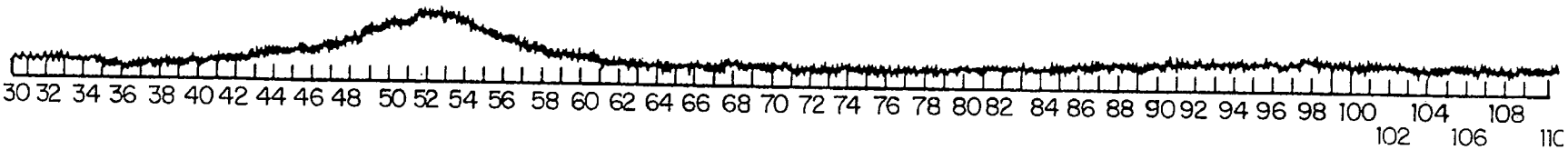
FIG. 1 (*a*) is a graph showing an X-ray diffraction pattern of the alloy of the present invention before heat treatment.

In the above magnetic alloy of the present invention, B is an indispensable element, which is dissolved in a bcc Fe, effective for making the crystal grains ultrafine and controlling the alloy's magnetostriction and magnetic anisotropy.

M is at least one element selected from Ti, Zr, Hf, V, Nb, Mo, Ta, Cr, W and Mn, which is also an indispensable element. By the addition of both M and B, the crystal grains can be made ultrafine, and the alloy's heat resistance can be improved.

The M content (x), the B content (y) and the total content of M and B (x+y) should meet the following requirements:

$4 \leqq x \leqq 15$, $2 \leqq y < 25$, and $7 \leqq x+y \leqq 35$.

When x and y are lower than the above lower limits, the alloy has poor heat resistance. On the other hand, when x and y are larger than the above upper limits, the alloy has poor saturation magnetic flux density and soft magnetic properties. Particularly, the preferred ranges of x and y are:

$5 \leqq x \leqq 15$, $10 < y < 20$, and $15 < x+y \leqq 30$.

With these ranges, the alloys show excellent heat resistance.

According to another aspect of the present invention, the above composition may further contain at least one element (X) selected from Si, Ge, P, Ga, Al and N, and at least one element (T) selected from Au, platinum group elements, Co, Ni, Sn, Be, Mg, Ca, Sr and Ba.

Accordingly, the following alloys are also included in the present application.

The magnetic alloy with ultrafine crystal grains according to another embodiment of the present invention has a composition represented by the general formula:

$$Fe_{100-x-y-z}M_xB_yX_z \text{ (atomic \%)}$$

wherein

M represents at least one element selected from Ti, Zr, Hf, V, Nb, Mo, Ta, Cr, W and Mn, X represents at least one element selected from Si, Ge, P, Ga, Al and N, $4 \leqq x \leqq 15$, $2 \leqq y \leqq 25$, $0 \leqq z \leqq 10$, and $7 \leqq x+y+z \leqq 35$, at least 50% of the alloy structure being occupied by crystal grains having an average grain size of 500 Å or less, and the crystal grains being based on a bcc structure.

The magnetic alloy with ultrafine crystal grains according to a further embodiment of the present invention has a composition represented by the general formula:

$$Fe_{100-x-y-b}M_xB_yT_b \text{ (atomic \%)}$$

wherein

M represents at least one element selected from Ti, Zr, Hf, V, Nb, Mo, Ta, Cr, W and Mn, T represents at least one element selected from Au, platinum group elements, Co, Ni, Sn, Be, Mg, Ca, Sr and Ba, $4 \leqq x \leqq 15$, $2 \leqq y \leqq 25$, $0 < b \leqq 10$, and $7 \leqq x+y+b \leqq 35$, at least 50% of the alloy structure being occupied by crystal grains having an average grain size of 500 Å or less, and the crystal grains being based on a bcc structure.

The magnetic alloy with ultrafine crystal grains according to a still further embodiment of the present invention has a composition represented by the general formula:

$$Fe_{100-x-y-z-b}M_xB_yX_zT_b \text{ (atomic \%)}$$

wherein

M represents at least one element selected from Ti, Zr, Hf, V, Nb, Mo, Ta, Cr, W and Mn, X represents at least one element selected from Si, Ge, P, Ca, Al and N, T represents at least one element selected from Au, platinum group elements, Co, Ni, Sn, Be, Mg, Ca, Sr and Ba, $4 \leqq x \leqq 15$, $2 \leqq y \leqq 25$, $0 \leqq z \leqq 10$, $0 \leqq b \leqq 10$, and $7 \leqq x+y+z+b \leqq 35$, at least 50% of the alloy structure being occupied by crystal grains having an average grain size of 500 Å or less, and the crystal grains being based on a bcc structure.

With respect to the element X, it is effective to control magnetostriction and magnetic anisotropy, and it may be added in an amount of 10 atomic % or less. When the amount of the element X exceeds 10 atomic %, the deterioration of soft magnetic properties takes place. The preferred amount of X is 0.5–8 atomic %.

With respect to the element T, it is effective to improve corrosion resistance and to control magnetic properties. The amount of T (b) is preferably 10 atomic % or less. When it exceeds 10 atomic %, extreme decrease in a saturation magnetic flux density takes place. The preferred amount of T is 0.5–8 atomic %.

The above-mentioned alloy of the present invention has a structure based on crystal grains having an average grain size of 500 Å or less. Particularly when the average grain size is 200 Å or less, excellent soft magnetic properties can be obtained.

In the present invention, ultrafine crystal grains should be at least 50% of the alloy structure, because if otherwise, excellent soft magnetic properties would not be obtained.

Depending upon the heat treatment conditions, an amorphous phase may remain partially, or the alloy structure may become 100% crystalline. In either case, excellent soft magnetic properties can be obtained.

The reason why excellent soft magnetic properties can be obtained in the magnetic alloy with ultrafine crystal grains of the present invention are considered as follows: In the present invention, M and B form ultrafine compounds based on bcc Fe and uniformly dispersed in the alloy structure by a heat treatment, suppressing the growth of such crystal grains. Accordingly, the magnetic anisotropy is apparently offset by this action of making the crystal grains ultrafine, resulting in excellent soft magnetic properties.

According to a further aspect of the present invention, there is provided a method of producing a magnetic alloy with ultrafine crystal grains comprising the steps of producing an amorphous alloy having either one of the above-mentioned compositions, and subjecting the resulting amorphous alloy to a heat treatment to cause crystallization, thereby providing the resulting alloy having a structure, at least 50% of which is occupied by crystal grains based on a bcc Fe solid solution and having an average grain size of 500 Å or less.

The amorphous alloy is usually produced by a liquid quenching method such as a single roll method, a double roll method, a rotating liquid spinning method, etc., by a gas phase quenching method such as a sputtering method, a vapor deposition method, etc. The amorphous alloy is subjected to a heat treatment in an inert gas atmosphere, in hydrogen or in vacuum to cause crystallization, so that at least 50% of the alloy structure is occupied by crystal grains based on a bcc structure solid solution and having an average grain size of 500 Å or less.

The heat treatment according to the present invention is preferably conducted at 450° C.–800° C. When the heat treatment is lower than 450° C., crystallization is difficult even though the heat treatment is conducted for a long period of time. On the other hand, when it exceeds 800° C., the crystal grains grow excessively, failing to obtain the desired ultrafine crystal grains. The preferred heat treatment temperature is 500°–700° C. Incidentally, the heat treatment time is generally 1 minute to 200 hours, preferably 5 minutes to 24 hours. The heat treatment temperatures and time may be determined within the above ranges depending upon the compositions of the alloys.

Since the alloy of the present invention undergoes a heat treatment at as high a temperature as 450°–800° C., glass bonding is easily conducted in the production of magnetic heads, providing the resulting magnetic heads with high reliability.

The heat treatment of the alloy of the present invention can be conducted in a magnetic field. When a magnetic field is applied in one direction, a magnetic anisotropy in one direction can be given to the resulting heat-treated alloy. Also, by conducting the heat treatment in a rotating magnetic field, further improvement in soft magnetic properties can be achieved. In addition, the heat treatment for crystallization can be followed by a heat treatment in a magnetic field.

The present invention will be explained in further detail by way of the following Examples, without intending to restrict the scope of the present invention.

EXAMPLE 1

An alloy melt having a composition (atomic %) of 7% Nb, 18% B and balance substantially Fe was rapidly quenched by a single roll method to produce a thin amorphous alloy ribbon of 18 μm in thickness.

Figure 1B:
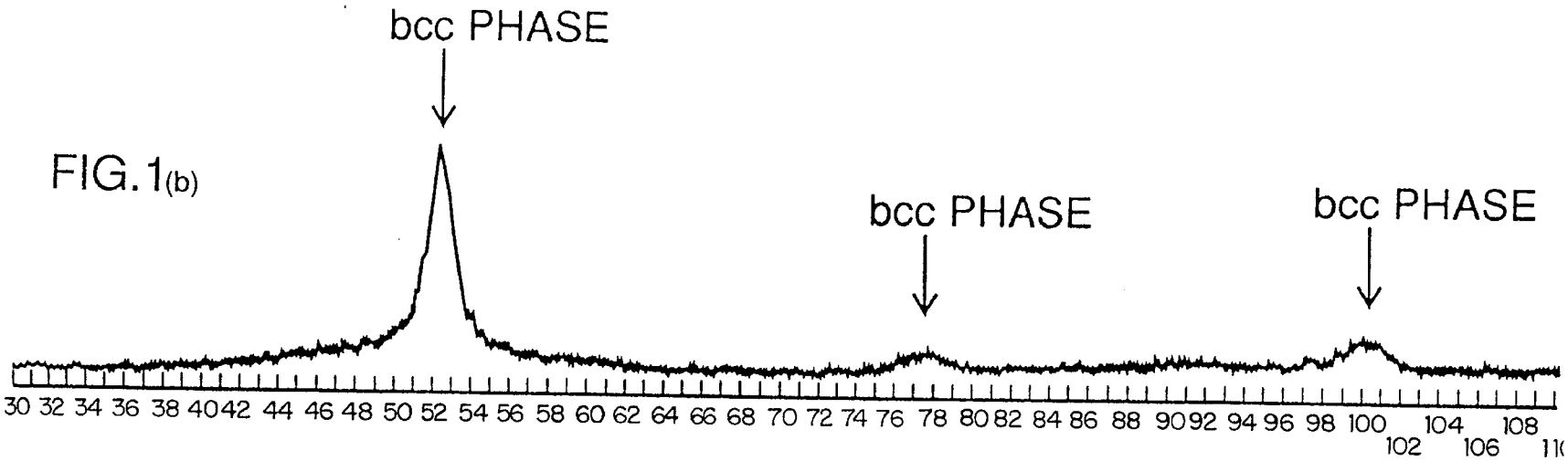

The X-ray diffraction pattern of this amorphous alloy before a heat treatment is shown in FIG. 1 (*a*). It is clear from FIG. 1 (*a*) that this pattern is a halo pattern peculiar to an amorphous alloy.

Next, this thin alloy ribbon was subjected to a heat treatment at 600° C. for 1 hour in a nitrogen gas atmosphere to cause crystallization, and then cooled to room temperature.

The X-ray diffraction pattern of the alloy obtained by the heat treatment at 600° C. is shown in FIG. 1 (*b*). As a result of X-ray diffraction analysis, it was confirmed that the alloy after a 600° C. heat treatment had a structure mostly constituted by ultrafine crystal grains made of a bcc Fe solid solution having a small half-width.

As a result of transmission electron photomicrography, it was confirmed that the alloy after the heat treatment had a structure mostly constituted by ultrafine crystal grains having an average grain size of 100 Å or less.

Incidentally, in the present invention, the percentage of ultrafine crystal grains is determined by a generally employed intersection method. In this method, an arbitrary line (length=L) is drawn on a photomicrograph such that it crosses crystal grains in the photomicrograph. The length of each crystal grains crossed by the line ($L_1$, $L_2$, $L_3$ . . . $L_n$) is summed to provide a total length ($L_1+L_2+L_3+ \ldots +L_n$), and the total length is divided by L to determine the percentage of crystal grains.

Where there are a large percentage of crystal grains in the alloy structure, it appears from the photomicrograph that the structure is almost occupied by crystal grains. However, even in this case, some percentage of an amorphous phase exists in the structure. This is because the periphery of each crystal grain looks obscure in the photomicrograph, suggesting the existence of an amorphous phase. Where there are a large percentage of such crystal grains, it is generally difficult to express the percentage of crystal grains by an accurate numerical value. Accordingly, in Examples, "substantially" or "mostly" is used.

Figure 2A:
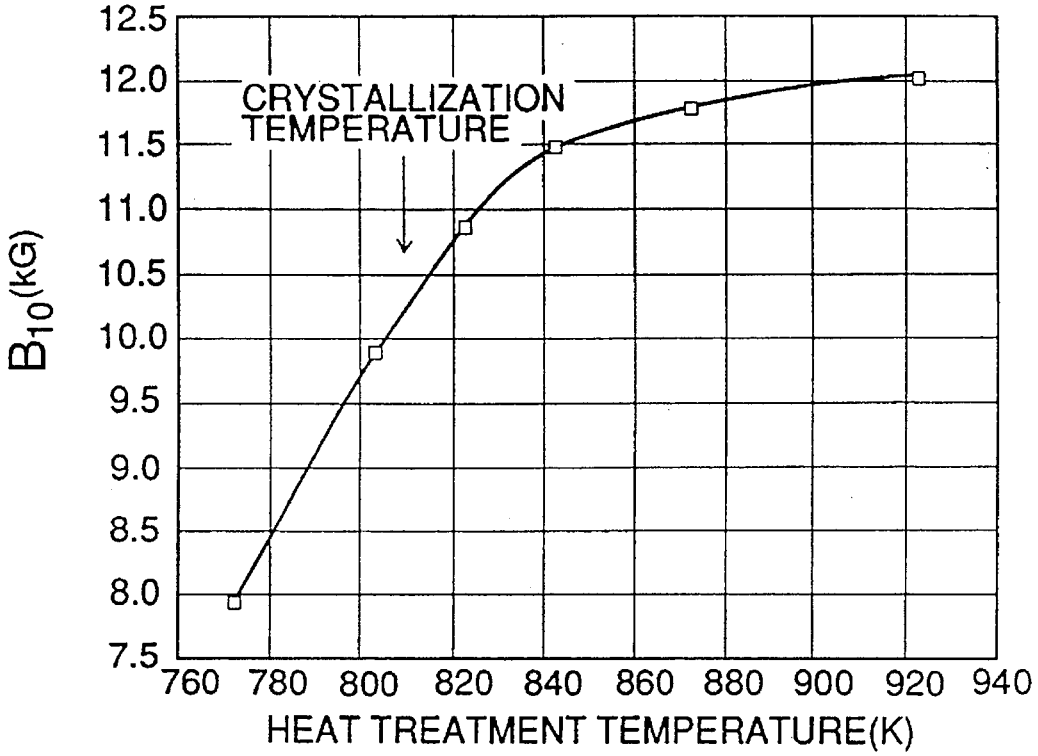
FIG. 2 (*a*) is a graph showing the relation between a saturation magnetic flux density ($B_{10}$) and a heat treatment temperature.
Figure 2B:
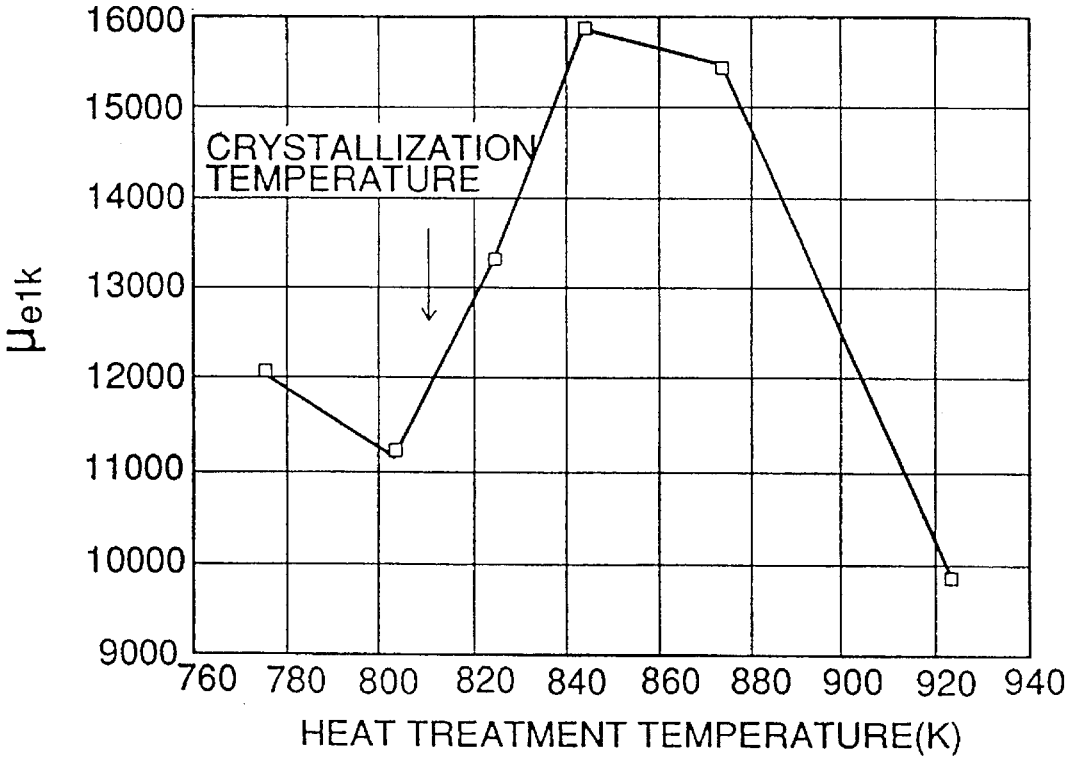
Figure 3:
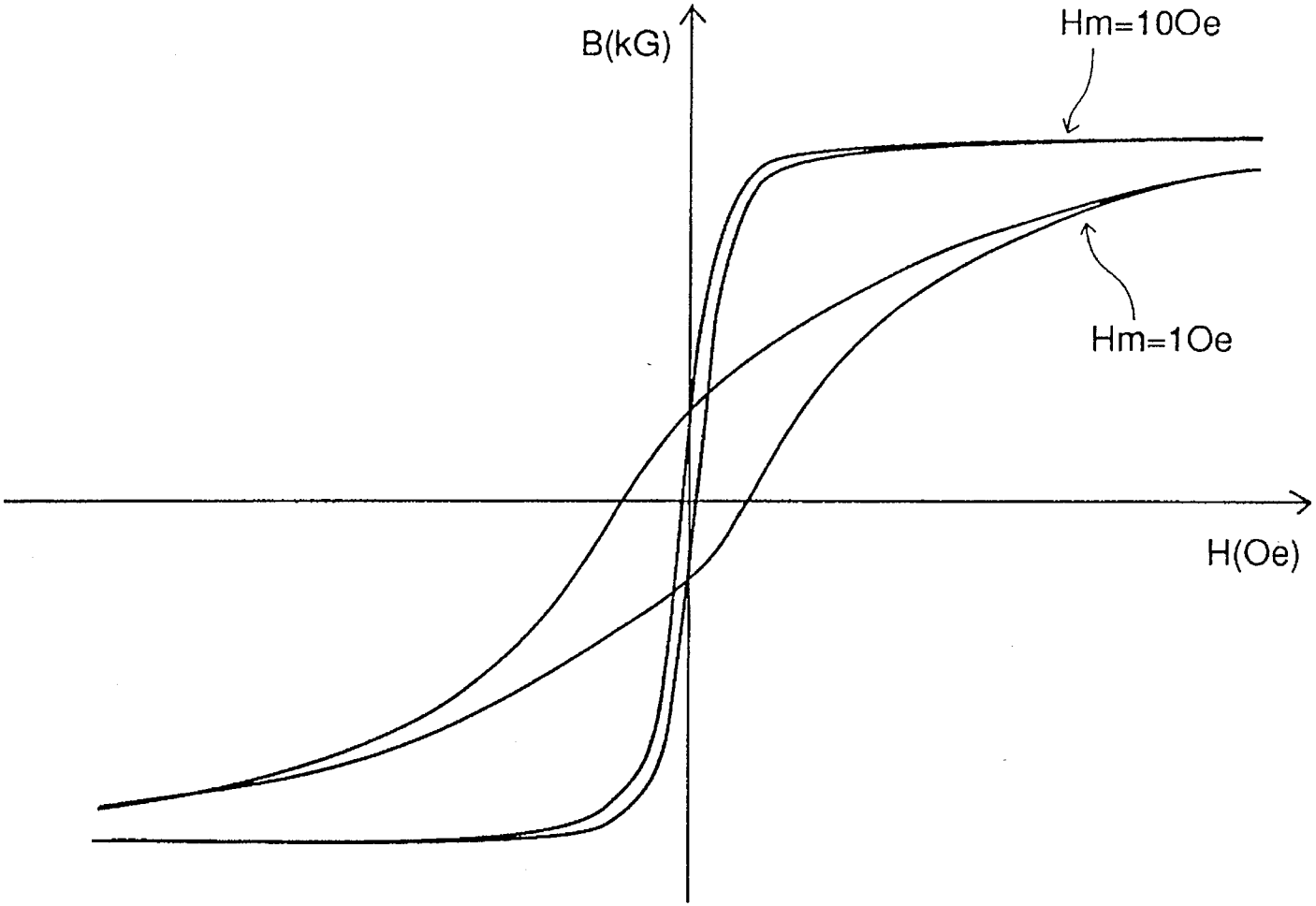
FIG. 3 is a graph showing the relation between a magnetic flux density B and a magnetic field intensity with respect to the alloy of the present invention.

Next, a toroidal core produced by the amorphous alloy of this composition was subjected to a heat treatment at various heat treatment temperatures without applying a magnetic field to measure a dc B-H hysteresis curve by a dc B-H tracer and an effective permeability $\mu_{e1k}$ at 1 kHz by an LCR meter. The heat treatment time was 1 hour, and the heat treatment atmosphere was a nitrogen gas atmosphere. The results are shown in FIGS. 2 (*a*) and (*b*). FIG. 3 shows the dc B-H hysteresis curve of $Fe_{75}Nb_7B_{18}$ heated at 630° C. for 1 hour, in which $B_{10}$=12.1 kG, $Br/B_{10}$=24%, and Hc=0.103 Oe.

It can be confirmed that at a heat treatment temperature higher than the crystallization temperature at which bcc Fe phases are generated, high saturation magnetic flux density and high permeability are obtained.

Thus, the alloy of the present invention can be obtained by crystallizing the corresponding amorphous alloy. The alloy of the present invention has extremely reduced magnetostriction than the amorphous counterpart, meaning that it is suitable as soft magnetic materials.

The alloy of the present invention shows higher saturation magnetic flux density than the Fe-Si-Al alloy, and its $\mu_{e1k}$ exceeds 10000 in some cases. Therefore, the alloy of the present invention is suitable for magnetic heads for high-density magnetic recording, choke cores, high-frequency transformers, sensors, etc.

EXAMPLE 2

Figure 4:
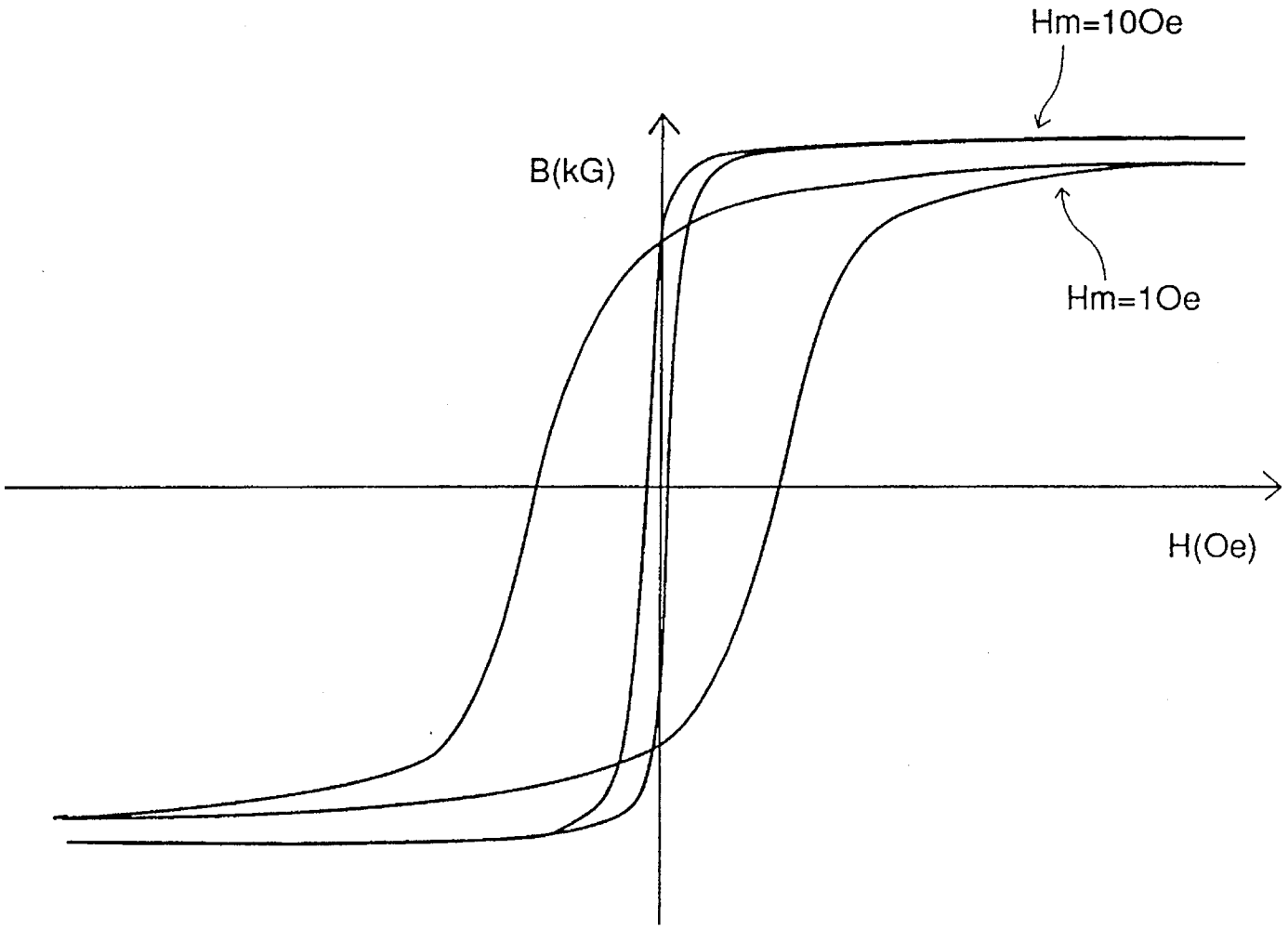
FIG. 4 is a graph showing the relation between a magnetic flux density B and a magnetic field intensity with respect to the alloy of the present invention.

Thin heat-treated alloy ribbons of 5 mm in width and 15 μm in thickness having the compositions shown in Table 1 were produced in the same manner as in Example 1. It was measured with respect to $B_{10}$ and Hc by a dc B-H tracer, an effective permeability $\mu_{e1k}$ at 1 kHz by an LCR meter, and a core loss Pc at 100 kHz and at 0.2 T by a U-function meter. The average crystal grain size and the percentage of crystal grains were determined by using the photomicrographs of the alloy structures. The results are shown in Table 1. Any of the heat-treated alloys had crystal grains based on a bcc structure and having an average grain size of 500 Å or less. The dc hysteresis curve of No. 1 alloy ($Fe_{79}Nb_7B_{14}$) shown in Table 1 is shown in FIG. 4, in which $B_{10}$=12.5 kG, $Br/B_{10}$=72%, and Hc=0.200 Oe.

The alloys of the present invention show saturation magnetic flux densities equal to or higher than those of the Fe-Si-Al alloy and the Co-base amorphous alloy, and also have higher $\mu_{e1k}$ than those of the Fe-Si, etc. Accordingly, the alloys of the present invention are suitable as alloys for magnetic heads.

TABLE 1

| Sample No.* | Composition (atomic %) | Average Grain Size (Å) | Crystal Grain Content (%) | $B_{10}$ (kG) | Hc (Oe) | $\mu_{e1k}$ | Pc (mW/cc) |
|---|---|---|---|---|---|---|---|
| 1 | $Fe_{bal}Nb_7B_{14}$ | 80 | 90 | 12.7 | 0.19 | 4000 | 1900 |
| 2 | $Fe_{bal}Hf_6B_{13}$ | 75 | about 100 | 14.1 | 0.38 | 3300 | 2200 |
| 3 | $Fe_{bal}Ta_{7.8}B_{18}$ | 60 | 95 | 12.4 | 0.28 | 7800 | 890 |
| 4 | $Fe_{bal}Nb_6B_{17}$ | 65 | 90 | 13.5 | 0.11 | 14800 | 520 |
| 5 | $Fe_{bal}Ti_{11}B_{13.2}Si_{0.9}$ | 95 | 95 | 12.2 | 0.42 | 3300 | 2400 |
| 6 | $Fe_{bal}Zr_{6.5}B_{14.3}Ge_{1.0}$ | 85 | 95 | 14.3 | 0.32 | 3900 | 1700 |
| 7 | $Fe_{bal}Hf_{6.3}B_{12}Ga_{0.4}$ | 85 | about 100 | 14.2 | 0.29 | 5700 | 1100 |
| 8 | $Fe_{bal}Zr_{6.5}B_{15.9}Al_{1.2}$ | 72 | 90 | 14.7 | 0.38 | 3800 | 2500 |
| 9 | $Fe_{bal}Nb_{6.7}B_{12}P_{0.5}$ | 95 | about 100 | 14.1 | 0.39 | 3600 | 2200 |
| 10 | $Fe_{bal}Mo_{8.0}B_{18}Al_{1.4}Au_{0.5}$ | 110 | 85 | 12.2 | 0.39 | 2900 | 2200 |

TABLE 1-continued

| Sample No.* | Composition (atomic %) | Average Grain Size (Å) | Crystal Grain Content (%) | $B_{10}$ (kG) | Hc (Oe) | $\mu_{e1k}$ | Pc (mW/cc) |
|---|---|---|---|---|---|---|---|
| 11 | $Fe_{bal}Ti_{7.5}B_{14.2}Ga_{1.2}Ag_{0.1}$ | 130 | 80 | 13.9 | 0.37 | 2900 | 2100 |
| 12 | $Fe_{bal}Zr_{8.7}B_{17.3}P_{1.2}$ | 85 | 95 | 13.7 | 0.33 | 3600 | 1900 |
| 13 | $Fe_{bal}Hf_{10}B_{20}Si_{1.1}Ru_{2.1}$ | 80 | 90 | 12.2 | 0.28 | 5600 | 1000 |
| 14 | $Fe_{bal}Ta_{8.2}B_{14.5}N_{0.1}Co_{9.9}$ | 75 | 75 | 13.4 | 0.22 | 5200 | 870 |
| 15 | $Fe_{bal}Nb_{6.7}B_{11}Ge_{1.1}Ni_{8.7}$ | 75 | about 100 | 13.5 | 0.35 | 3300 | 1600 |
| 16 | $Fe_{bal}Ti_{8.8}B_{11.2}Sn_{1.8}Mg_{0.1}$ | 120 | 90 | 14.3 | 0.33 | 3000 | 2200 |
| 17 | $Fe_{bal}Zr_{10.6}B_{12.8}Be_1Rh_{1.4}$ | 85 | 90 | 13.9 | 0.32 | 4100 | 2100 |
| 18 | $Fe_{bal}Al_{7.6}Si_{17.9}$ Layer | — | — | 10.3 | — | 1500 | — |
| 19 | $Fe_{bal}Si_{12.5}$ Layer | — | — | 17.6 | — | 400 | — |
| 20 | $Co_{bal}Fe_{4.7}Si_{15.0}B_{10}$ Amorphous | — | — | 8.0 | 0.006 | 8500 | 350 |

Note*:
Sample Nos. 1–17: Present invention.
Sample Nos. 18–20: Conventional alloy.

EXAMPLE 3

Thin amorphous alloy ribbons of 5 mm in width and 15 μm in thickness having the compositions shown in Table 2 were produced by a single roll method. Next, each of these thin alloy ribbons was formed into a toroidal core of 19 mm in outer diameter and 15 mm in inner diameter, and subjected to a heat treatment at 550° C.–700° C. in an Ar gas atmosphere to cause crystallization.

As a result of X-ray diffraction analysis and transmission electron photomicrography, it was confirmed that the alloys after the heat treatment had structures mostly constituted by ultrafine crystal grains based on a bcc structure and having an average grain size of 500 Å or less.

With respect to newly prepared thin amorphous alloy ribbons having the above-mentioned compositions, they were formed into toroidal cores in the same manner as above and measured on effective permeability $\mu_{e1k}$ at 1 kHz. Next, they were subjected to a heat treatment at 600° C. for 30 minutes and cooled to room temperature. Their effective permeabilities ($\mu_{e1k}^{30}$) at 1 kHz were also measured. The values of $\mu_{e1k}^{30}/\mu_{e1k}$ are shown in Table 2.

TABLE 2

| Sample No.* | Composition (atomic %) | Average Grain Size (Å) | Crystal Grain Content (%) | $\mu_{e1k}^{30}/\mu_{e1k}$ |
|---|---|---|---|---|
| 21 | $Fe_{bal}Zr_8B_{14}$ | 70 | 95 | 0.85 |
| 22 | $Fe_{bal}Hf_7B_{16}$ | 55 | 85 | 0.82 |
| 23 | $Fe_{bal}Ta_7B_{17}$ | 60 | 90 | 0.83 |
| 24 | $Fe_{bal}Nb_8B_{19}$ | 65 | 95 | 0.87 |
| 25 | $Fe_{bal}Hf_8Mn_{1.5}B_{13}Ga_2$ | 80 | about 100 | 0.79 |
| 26 | $Fe_{bal}Zr_9B_{16}Al_2$ | 85 | 95 | 0.80 |
| 27 | $Fe_{bal}Ti_{11}B_{19}Ga_{0.5}$ | 120 | 90 | 0.88 |
| 28 | $Fe_{bal}Zr_{13}B_{17}P_{0.5}$ | 90 | 80 | 0.87 |
| 29 | $Fe_{bal}Hf_{10}B_{15}Si_2Ru_2Co_5$ | 110 | 80 | 0.82 |
| 30 | $Fe_{bal}Nb_8B_{13}Ge_1Ni_1$ | 120 | 80 | 0.77 |
| 31 | $Fe_{bal}Zr_6B_{14}Be_{0.5}Rh_2$ | 220 | 85 | 0.76 |
| 32 | $Fe_{bal}Nb_5B_{11}$ | 240 | 90 | 0.72 |
| 33 | $Fe_{bal}Zr_5B_{11}$ | 160 | about 100 | 0.73 |
| 34 | $Fe_{bal}Nb_7B_7$ | 180 | about 95 | 0.65 |
| 35 | $Fe_{bal}Zr_6B_5$ | 240 | about 100 | 0.63 |
| 36 | $Fe_{bal}Ta_7B_7$ | 230 | about | 0.66 |

TABLE 2-continued

| Sample No.* | Composition (atomic %) | Average Grain Size (Å) | Crystal Grain Content (%) | $\mu_{e1k}^{30}/\mu_{e1k}$ |
|---|---|---|---|---|
| 37 | $Fe_{bal}Ti_8B_4$ | 220 | 100 about 100 | 0.62 |
| 38 | $Fe_{bal}W_5B_8$ | 210 | about 100 | 0.68 |
| 39 | $Co_{bal}Fe_{4.7}Si_{15}B_{10}$ Amorphous | — | 0 | almost 0 |
| 40 | $Fe_{bal}Si_9B_{13}$ Amorphous | — | 0 | almost 0 |
| 41 | $Co_{bal}Nb_{10}Zr_3$ Amorphous | — | 0 | almost 0 |
| 42 | $Fe_{bal}Zr_1B_9$ | 240 | 100 | 0.35 |
| 43 | $Fe_{bal}Hf_2B_8$ | 220 | 100 | 0.38 |

Note*:
Sample Nos. 21–38: Present invention.
Sample Nos. 39–43: Comparative Examples.

It is clear from Table 2 that the alloys of the present invention show extremely larger $\mu_{e1k}^{30}/\mu_{e1k}$ than those of the conventional materials, and so excellent heat resistance, suffering from less deterioration of magnetic properties even at as high a temperature as 600° C. Accordingly, they are suitable as magnetic materials for magnetic heads needing glass bonding, sensors operated at high temperature, etc.

Incidentally, in the alloy of the present invention, the larger the B content, the larger the value of $\mu_{e1k}^{30}/\mu_{e1k}$. In addition, when the M content is smaller than the lower limit of the range of the present invention, $\mu_{e1k}^{30}/\mu_{e1k}$ is low, meaning that the heat resistance is poor.

EXAMPLE 4

Alloy layers having compositions shown in Table 3 were produced on fotoceram substrates by a sputtering method, and subjected to a heat treatment at 550°–700° C. for 1 hour to cause crystallization. At this stage, their $\mu_{e1M}^{0}$ was measured.

As a result of X-ray diffraction analysis and transmission electron photomicrography, it was confirmed that the alloys after the heat treatment had structures mostly constituted by ultrafine crystal grains based on a bcc structure and having an average grain size of 500 Å or less.

Next, these alloys were introduced into an oven at 550° C., and kept for 1 hour and cooled to room temperature to measure their $\mu_{e1M}^{1}$. Their $\mu_{e1M}^{1}/\mu_{e1M}^{0}$ ratios are shown in Table 3.

TABLE 3

| Sample No.* | Composition (atomic %) | Average Grain Size (Å) | Crystal Grain Content (%) | $\mu_{e1M}^{1}/\mu_{e1M}^{0}$ |
|---|---|---|---|---|
| 44 | $Fe_{bal}Zr_{8.9}B_{18.5}$ | 65 | 85 | 0.91 |
| 45 | $Fe_{bal}Hf_{7.7}B_{16.7}$ | 70 | 90 | 0.90 |
| 46 | $Fe_{bal}Ta_{7.9}B_{15.1}$ | 60 | 95 | 0.89 |
| 47 | $Fe_{bal}Nb_{8.2}B_{14.5}$ | 60 | 80 | 0.91 |
| 48 | $Fe_{bal}Cr_{12.1}B_{19.1}Si_{1.5}$ | 290 | about 95 | 0.91 |
| 49 | $Fe_{bal}W_{8.9}B_{14.5}Ge_{1.4}$ | 130 | about 85 | 0.92 |
| 50 | $Fe_{bal}Mn_{12.9}B_{15.8}P_{0.8}$ | 380 | about 80 | 0.93 |
| 51 | $Fe_{bal}Hf_{8.6}B_{12.8}Ga_{1.4}$ | 60 | about 100 | 0.91 |
| 52 | $Fe_{bal}Zr_{8.6}B_{16.9}Al_{1.4}$ | 75 | about 100 | 0.96 |
| 53 | $Fe_{bal}Nb_{8.8}B_{14.9}N_{0.9}$ | 55 | about 100 | 0.92 |
| 54 | $Fe_{bal}Mo_{11.0}B_{17.8}Al_{1.2}Au_{1.1}$ | 120 | 75 | 0.91 |
| 55 | $Fe_{bal}Ti_{10.6}B_{17.6}Ga_{0.9}$ | 130 | 85 | 0.90 |
| 56 | $Fe_{bal}Zr_{12.7}B_{17.3}P_{2.1}$ | 90 | 90 | 0.89 |
| 57 | $Fe_{bal}Hf_{9.9}B_{14.8}Si_{1.1}Ru_{1.6}$ | 85 | 95 | 0.91 |
| 58 | $Fe_{bal}Ta_{8.2}B_{13.8}N_{0.1}Co_{8.9}$ | 55 | about 100 | 0.92 |
| 59 | $Fe_{bal}Nb_{7.7}B_{19.8}Ge_{1.8}Ni_{5.7}$ | 65 | 85 | 0.90 |
| 60 | $Fe_{bal}Ti_{8.8}B_{17.2}Pt_{0.1}Sn_{1.1}Mg_{0.1}Co_{1.2}$ | 140 | 80 | 0.90 |
| 61 | $Fe_{bal}Zr_{10.2}B_{15.6}Ge_{0.2}Rh_{1.8}$ | 70 | 75 | 0.92 |
| 62 | Fe—C Layer $Co_{8.9}$ | 200 | about 100 | almost 0 |
| 63 | Fe—N Layer $Co_{8.9}$ | 230 | about 100 | almost 0 |

Note*:
Sample Nos. 44–61: Present invention.
Sample Nos. 62–63: Conventional alloy layer.

The alloy layers of the present invention show $\mu_{e1M}^{1}/\mu_{e1M}^{0}$ closer to 1 than the alloys of Comparative Examples, and suffer from less deterioration of magnetic properties even at a high temperature, showing better heat resistance. Thus, the alloys of the present invention are suitable for producing high-reliability magnetic heads.

According to the present invention, magnetic alloy with ultrafine crystal grains having excellent saturation magnetic flux density, permeability and heat resistance can be produced.

What is claimed is:

1. A magnetic core consisting essentially of a soft magnetic alloy with ultrafine crystal grains having a composition represented by the general formula consisting essentially of:

$$Fe_{100-x-y}M_xB_y \text{ (atomic \%)}$$

wherein

M represents at least one element selected from the group consisting of Ti, Zr, Hf, V, Nb, Mo, Ta, Cr, W and Mn, $4 \leqq x \leqq 15$, $2 \leqq y \leqq 25$, and $7 \leqq x+y \leqq 35$, at least 50% of the alloy structure being occupied by crystal grains having an average grain size of 240 Å or less, said crystal grains being based on a bcc structure, and said magnetic core having $\mu_{e1k}$ of 2900 or more and $\mu_{e1k}^{30}/\mu_{e1k}$ of 0.62 or more wherein $\mu_{e1k}$ represents an effective permeability at 1 kHz and $\mu_{e1k}$ represents an effective permeability at 1 kHz after heat treatment at 600° C. for 30 minutes.

2. A magnetic core consisting essentially of a soft magnetic alloy with ultrafine crystal grains having a composition represented by the general formula consisting essentially of:

$$Fe_{100-x-y-z}M_xB_yX_z \text{ (atomic \%)}$$

wherein

M represents at least one element selected from the group consisting of Ti, Zr, Hf, V, Nb, Mo, Ta, Cr, W and Mn, X represents at least one element selected from the group consisting of Si, Ge, P, Ga, and Al, $4 \leqq x \leqq 15$, $2 \leqq y \leqq 25$, $0 \leqq z \leqq 10$, $7 \leqq x+y+z \leqq 35$, at least 50% of the alloy structure being occupied by crystal grains having an average grain size of 240 Å or less, said crystal grains being based on a bcc structure, and said magnetic core having $\mu_{e1k}$ of 2900 or more and $\mu_{e1k}^{30}/\mu_{e1k}$ of 0.62 or more wherein $\mu_{e1k}$ represents an effective permeability at 1 kH and $\mu_{e1k}^{30}$ represents an effective permeability at 1 kHz after heat treatment at 600° C. for 30 minutes.

3. A magnetic core consisting essentially of a soft magnetic alloy with ultrafine crystal grains having a composition represented by general formula consisting essentially of:

$$Fe_{100-x-y-b}M_xB_yT_b \text{ (atomic \%)}$$

wherein

M represents at least one element selected from the group consisting of Ti, Zr, Hf, V, Nb, Mo, Ta, Cr, W and Mn, T represents at least one element selected from the group consisting of platinum group elements, Co, Ni, Be, Mg, Ca, Sr and Ba, $4 \leqq x \leqq 15$, $2 \leqq y \leqq 25$, $0 \leqq b \leqq 10$, and $7 \leqq x+y+b \leqq 35$, at least 50% of the alloy structure being occupied by crystal grains having an average grain size of 240 Å or less, said crystal grains being based on a bcc structure, and said magnetic core having $\mu_{e1k}$ of 2900 or more and $\mu_{e1k}^{30}/\mu_{e1k}$ of 0.62 or more wherein $\mu_{e1k}$ represents an effective permeability at 1 kHz and $\mu_{e1k}^{30}$ represents an effective permeability at 1 kHz after heat treatment at 600° C. for 30 minutes.

4. A magnetic core consisting essentially of a soft magnetic alloy with ultrafine crystal grains having a composition represented by general formula consisting essentially of:

$$Fe_{100-x-y-z-b}M_xB_yX_zT_b \text{ (atomic \%)}$$

wherein

M represents at least one element selected from the group consisting of Ti, Zr, Hf, V, Nb, Mo, Ta, Cr, W and Mn, X represents at least one element selected from the group consisting of Si, Ge, P, and Al, T represents at least one element selected from the group consisting of platinum group elements, Co, Ni, Be, Mg, Ca, Sr and Ba, $4 \leqq x \leqq 15$, $2 \leqq y \leqq 25$, $0 \leqq z \leqq 10$, $0 \leqq b \leqq 10$, $7 \leqq x+y+z+b \leqq 35$, at least 50% of the alloy structure being occupied by crystal grains having an average grain size of 240 Å or less, said crystal grains being based on a bcc structure, and said magnetic core having $\mu_{e1k}$ of 2900 or more and $\mu_{e1k}^{30}/\mu_{e1k}$ of 0.62 or more wherein $\mu_{e1k}$ represents an effective permeability at 1 kHz and $\mu_{e1k}^{30}$ represents an effective permeability at 1 kHz after heat treatment at 600° C. for 30 minutes.

5. The magnetic core according to claim 1, wherein the balance of said alloy structure is composed of an amorphous phase.

6. The magnetic core according to claim 2, wherein the balance of said alloy structure is composed of an amorphous phase.

7. The magnetic core according to claim 3, wherein the balance of said alloy structure is composed of an amorphous phase.

8. The magnetic core according to claim 4, wherein the balance of said alloy structure is composed of an amorphous phase.

9. The magnetic core according to claim 1, wherein said alloy is substantially composed of a crystalline phase.

10. The magnetic core according to claim 2, wherein said alloy is substantially composed of a crystalline phase.

11. The magnetic core according to claim 3, wherein said alloy is substantially composed of a crystalline phase.

12. The magnetic core according to claim 4, wherein said alloy is substantially composed of a crystalline phase.

13. The magnetic core according to claim 1, wherein said y satisfies $10<y\leqq 20$.

14. The magnetic core according to claim 2, wherein said y satisfies $10<y\leqq 20$.

15. The magnetic core according to claim 3, wherein said y satisfies $10<y\leqq 20$.

16. The magnetic core according to claim 4, wherein said y satisfies $10<y\leqq 20$.

17. The magnetic core according to claim 5, wherein said y satisfies $10<y\leqq 20$.

18. The magnetic core according to claim 6, wherein said y satisfies $10<y\leqq 20$.

19. The magnetic core according to claim 1, wherein said crystal grains have an average grain size of 200 Å or less.

20. The magnetic core according to claim 2, wherein said crystal grains have an average grain size of 200 Å or less.

21. The magnetic core according to claim 3, wherein said crystal grains have an average grain size of 200 Å or less.

22. The magnetic core according to claim 4, wherein said crystal grains have an average grain size of 200 Å or less.

23. The magnetic core according to claim 5, wherein said crystal grains have an average grain size of 200 Å or less.

24. The magnetic core according to claim 6, wherein said crystal grains have an average grain size of 200 Å or less.

25. The magnetic core according to claim 7, wherein said crystal grains have an average grain size of 200 Å or less.

* * * * *